United States Patent [19]

Varghese

[11] Patent Number: 4,610,777

[45] Date of Patent: Sep. 9, 1986

[54] COAL LIQUEFACTION WITH MN NODULES

[75] Inventor: Philip Varghese, Newtown, Pa.

[73] Assignee: Mobil Oil Corporation, New York, N.Y.

[21] Appl. No.: 641,096

[22] Filed: Aug. 15, 1984

[51] Int. Cl.[4] ..... C10G 1/00

[52] U.S. Cl. ..... 208/417; 208/309; 208/952; 208/431; 208/419; 208/414; 208/433

[58] Field of Search ..... 208/10, 8 LE, 309

[56] References Cited

U.S. PATENT DOCUMENTS

| | | | |
|---|---|---|---|
| 3,852,182 | 12/1974 | Sze et al. | 208/10 |
| 3,923,634 | 12/1975 | Silvestri et al. | 208/10 |
| 4,029,567 | 6/1977 | Farnano et al. | 208/8 LE |
| 4,124,486 | 11/1978 | Nolley, Jr. | 208/309 |
| 4,125,459 | 11/1978 | Garwin | 208/309 |
| 4,264,429 | 4/1981 | Rosenthal et al. | 208/10 |
| 4,292,168 | 9/1981 | Derbyshire et al. | 208/107 |
| 4,303,497 | 12/1981 | Mitchell et al. | 208/10 |
| 4,350,582 | 9/1982 | Rosenthal et al. | 208/10 |
| 4,448,672 | 5/1984 | Angevine et al. | 208/313 |
| 4,452,688 | 6/1984 | Mitchell et al. | 208/10 |
| 4,461,694 | 7/1984 | Givens et al. | 208/8 LE |

*Primary Examiner*—John Doll
*Assistant Examiner*—Lance Johnson
*Attorney, Agent, or Firm*—Alexander J. McKillop; Michael G. Gilman; Charles A. Malone

[57] ABSTRACT

A method for the liquefaction of coal under coal liquefaction conditions in the presence of manganese nodules in combination with an improved coal liquefaction solvent. Liquid yields are increased when the solvent, containing substantially only polycondensed aromatic systems or components that possess polargraphic reduction potentials equal to or greater than about −2.4 volts, is utilized in the reaction. During the reaction the polycondensed aromatic compounds, in the presence of manganese, are selectively and rapidly hydrogenated leading to increased liquefaction of coal.

20 Claims, 2 Drawing Figures

COAL LIQUEFACTION WITH MN NODULES

FIELD OF THE INVENTION

This invention relates to the liquefaction of coal and relates more particularly to the hydrogenative liquefaction of coal employing a catalyst.

BACKGROUND OF THE INVENTION

U.S. Pat. No. 3,214,236 discloses hydrogenation as a conversion process in which manganese nodules are catalytically useful. This patent also discloses that the manganese nodule catalyst can be a source of manganese and other valuable metals after being spent in effecting the conversion process.

U.S. Pat. No. 3,509,041 discloses the use of manganese nodules, after pretreatment by base exchange to bond hydrogen ions thereto, in hydrocarbon conversion reactions, specifically cracking, hydrocracking, oxidation, olefin hydrogenation, and olefin isomerization.

As disclosed in U.S. Pat. No. 3,923,634, a coal liquefaction operation may also be carried out in a wet state. Here the coal and the catalyst, desirably crushed, are mixed with a hydrogen rich solvent and the resulting wet mixture subjected to the action of hydrogen at a suitably high temperature. Hydrogen rich solvents which may be employed include hydrocarbonaceous solvents such as gas oil. These solvents may also include those obtained by partial hydrogenation and distillation of coal tar.

Heretofore solvents, e.g., coal tars, used in the liquefaction of coal required hydrogenation to enhance their hydrogen donor effectiveness and adequately solubilize coal. Hydrogenation of a solvent separately from the coal liquefaction stage is a costly way of regenerating H-donor solvents. Therefore, it is economically advantageous to have a single stage coal liquefaction process. Using such a process, coal liquefaction and solvent hydrogenation suitable to yield H-donor species could be carried out in the same reactor.

Considerable difficulties are encountered in single stage coal liquefaction process. One difficulty is the selection of a catalyst which will hydrogenate selective solvent components that make good H-donors. Another difficulty is that the selected catalyst must possess activity under conditions where rapid fouling by coal derived materials may be expected. Yet another difficulty is the selection of a catalyst which can resolve the above difficulties and be purchased at a low cost. These difficulties have been resolved in this single stage coal liquefaction process which utilizes manganese nodules as a catalyst.

SUMMARY

This invention discloses a method for the liquefaction of coal under coal liquefaction conditions in the presence of manganese nodules in combination with an improved coal liquefaction solvent. This method includes reacting the coal with hydrogen in the presence of manganese nodules which occur naturally underwater as deposits. In order to increase liquid yields, a solvent, containing substantially high levels of only polycondensed aromatic systems or components that possess polarographic reduction potentials equal to or greater than about −2.4 volts, is utilized in the reaction. The reaction is conducted at a temperature of about 500° F. to about 800° F. at a pressure of about 1000 psig to about 3000 psig for from about 15 minutes to about 2 hours. After the reaction is completed hydrocarbons are recovered.

It therefore is an object of this invention to provide a means of generating an improved coal liquefaction solvent which in the presence of manganese nodules can be selectively and rapidly hydrogenated to compounds which are very effective H-donors.

It is a further object of this invention to provide a coal liquefaction solvent which will give increased yields of liquid product.

A still further object of this invention is to eliminate the need to partially prehydrogenate a coal liquefaction solvent in a separate hydrogenation stage.

A yet further object of this invention is to provide for a coal liquefaction solvent which will give more complete coal liquefaction reactions.

A still further object of this invention is to provide a catalytic liquefaction in conjunction with a specified recycle solvent in which the catalyst is disposable.

DESCRIPTION OF THE PREFERRED EMBODIMENTS

Figure 1:
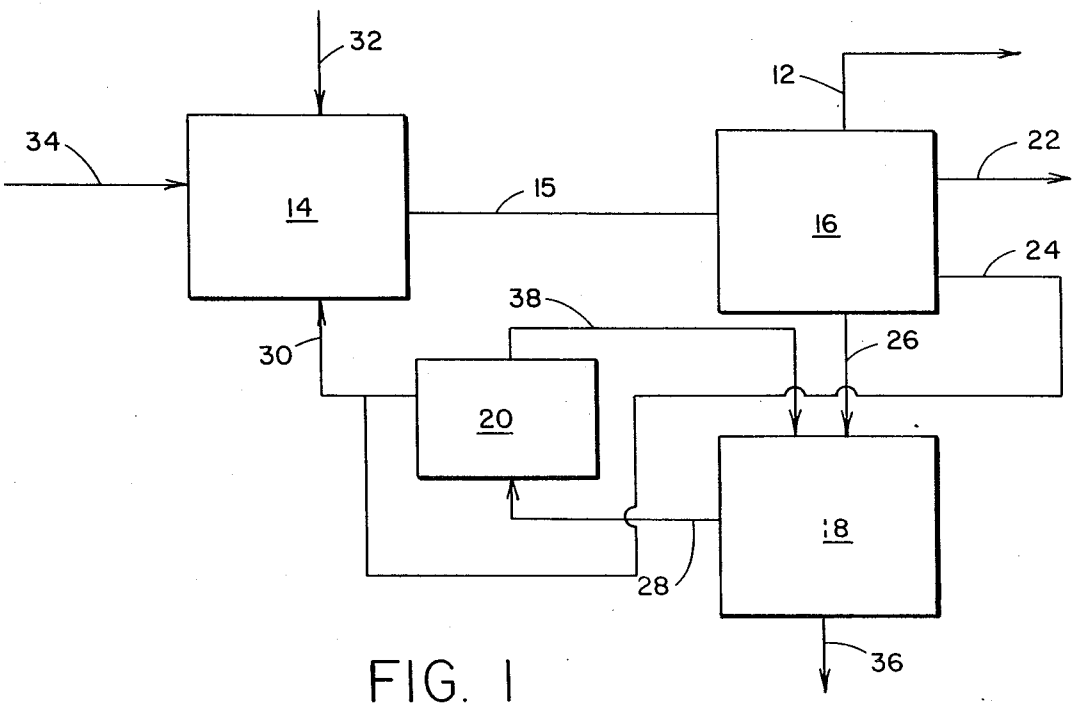
FIG. 1 is a schematic representation of one embodiment of the invention.

Coal can be processed in the absence of added catalyst to provide a liquid hydrocarbonaceous product. This liquefaction can be effected by reacting the coal at high temperatures with hydrogen or with a mixture of carbon monoxide and water. The yield of the liquid product obtained by this processing is comparatively low and an improvement in the yield of the liquid product can be obtained by carrying out the reaction in the presence of added catalyst. Catalysts which have been employed for this purpose include, for example, stannous chloride and a complex of nickel and molybdenum. However, while the yield of the liquid product employing these catalysts is increased, the cost of the added catalyst is a significant portion of the overall cost of the liquefaction procedure. Accordingly, it is desirable to provide a liquefaction procedure in which the cost of the added catalyst is a relatively insignificant portion of the overall cost of the operation.

By the process of this invention, an economical and effective liquefaction of coal is obtained. Manganese nodules are readily available in large quantities and are relatively inexpensive. Further, the material derived from the nodules is capable of providing satisfactorily high yields of liquid products from the coal. Thus, high yields of liquid hydrocarbonaceous product are obtained from coal by a process in which the cost of the catalyst is practically negligible.

Manganese nodules, as is known, are naturally occurring deposits of manganese, along with other metals, including iron, cobalt, nickel, and copper, found on the floor of bodies of water. They are found in abundance on the floors of oceans and lakes. For example, they are found in abundance on the floor of the Atlantic and Pacific oceans and on the floor of Lake Michigan. The nodules are characterized by a large surface area, i.e., in excess of about 100 square meters per gram. Those from the floor of bodies of fresh water, such as the floor of Lake Michigan, tend to be smaller in size. Their color varies from earthy black to brown depending upon their relative manganese and iron content. The nodules are porous and light, having an average specific gravity of about 2.4. Generally, they range from $\frac{1}{8}$ inch to 9 inches in diameter but may extend up to considerably larger sizes approximating 4 feet in length and 3 feet in diameter and weighing as much as 1700 pounds. In addition to the metals mentioned above, the nodules contain silicon, aluminum, calcium and magnesium, and small amounts of molybdenum, zinc, lead, vanadium, and rare earth metals.

The manganese nodules substantially as mined, or recovered, from the floor of the body of the water in which they occur, can be employed as the catalyst for the liquefaction of the coal. Thus, the nodules, as mined, possibly after washing to remove sea water or lake water therefrom and mud or other loose material from the surface of the nodules, may be employed for coal liquefaction. The nodules, of course, may be crushed and sized to obtain a desired particle size.

In carrying out the process of the invention, any coal heretofore subjected to coal liquefaction procedures may be employed. These coals are bituminous, subbituminous, or lignite coals. Satisfactory results are obtained by employing such coals as high volatile "A-type" bituminous coal, for example Pittsburgh Seam coal, or high volatile "C-type" coal, for example Wyoming Rock Springs coal, and others.

The coal and the material derived from the manganese nodules may be employed in any ratio. Any finite amount of the material derived from the manganese nodules appears to increase the yield of the liquid product. Preferably, however, the material derived from the manganese nodules is employed in the amount of at least 5% by weight of the coal and catalyst mixture. Greater amounts, within limits, improve the yield of the liquid product. Thus, it is preferred that the amount of material derived from the manganese nodules be at least 10% of the coal and catalyst mixture. Satisfactory results are obtained where the material derived from the manganese nodules is employed in an amount equal to about 25 wt. % of the coal charged. Greater amounts, of course, may be employed, although with greater amounts the increases in yield may be compensated by decreased throughput in the liquefaction apparatus.

Liquefaction occurs when the coal and added catalyst mixture is reacted with hydrogen or with a mixture of carbon monoxide and water. The conversion occurs most efficiently with an excess of hydrogen or of carbon monoxide at elevated pressure. The pressure ordinarily should be at least 1000 pounds per square inch gauge (psig). However, higher pressures of hydrogen are desirable. Thus, for example, the pressure may be at least 2000 psig. Even better results are obtained with even higher pressures in the order of about 2500 psig or higher.

The temperature during the liquefaction procedure should be at least about 500° F. However, higher temperatures such as those of about 800° F. may be employed. Generally, any temperature heretofore employed for coal liquefaction will be satisfactory. The reaction temperature should be maintained for about 0.25 of an hour to about 2 hours.

The coal liquefaction operation is preferably carried out in a wet state. In this type of operation, the coal and the catalyst, desirably crushed, are mixed with a solvent that is potentially a good donor solvent and the resulting wet mixture subjected to the action of the hydrogen at a suitably high temperature and pressure. Hydrogen rich solvents which may be employed include hydrocarbonaceous solvents such as gas oil. They also include those obtained by partial hydrogenation and distillation of coal tar.

The recycled liquefaction solvent should be derived in a fashion so as to enrich it in the components that act synergistically with manganese nodules. We have found that polycondensed aromatics and other similar species that possess a polarographic reduction potential greater than about −2.4 volts are selectively hydrogenated by manganese nodules. Such compounds when hydrogenated make excellent H-donors. Manganese nodules possess little activity for the hydrogenation of lower boiling conventional donor precursors such as naphthalene and also possess little desulfurization activity. Their utility in effect is thus limited to streams containing high proportions of compounds that are susceptible to hydrogenation by manganese nodules.

Such suitable solvents can be derived from the 600° F. and higher boiling liquids by the use of solvent fractionating techniques as described below.

Other suitable solvents possessing the desired polarographic potential are described in U.S. Pat. No. 4,292,168 issued to Derbyshire et al. This patent is hereby incorporated by reference.

To obtain a greater yield from the coal liquefaction process, in FIG. 1, the liquified coal resultant from a wet state coal liquefaction process is sent into a boiling point separator 16, from the reactor 14 via line 15. Manganese nodules enter the reactor 14 via line 32. Slurried coal enters the reactor 14 via line 34. Alternately, the nodules, coal and solvent may be slurried into a single stream. From the boiling point separator 16, the liquid yield is separated into four streams. One stream contains the light products, mostly hydrocarbonaceous gases, which leave the boiling point separator via line 20. Intermediate product from the boiling point separator 16 is divided into two streams. One stream emanating from line 22 contains liquid hydrocarbonaceous components which have boiling points less than about 600° F. The other stream emanating from line 24 contains hydrocarbonaceous liquids having boiling points greater than from about 600° F. to about 800° F. Residual or bottom liquids leave the boiling point separator 16 via line 26. The residual or bottom liquids contain hydrocarbonaceous components having boiling points of more than about 800° F.

In general, on completion of the liquefaction reaction, the product mixture will contain ash, catalyst, and some unconverted carbonaceous residue in addition to hydrocarbonaceous liquid. The hydrocarbonaceous liquid may be recovered by filtration, centrifugation, distillation, extraction or suitable combinations thereof, and is suitable for use as a liquid fuel without further treatment. Alternatively, it may be further refined by solvent extraction or other techniques to recover aromatic hydrocarbons, petrochemical feedstocks or lubricants.

In one embodiment, as shown in FIG. 1, the residual or non-distillable bottoms stream from line 26 is deasphalted in deasphalter 18, using methods known to those skilled in the art. Afterwards, the deasphalted product is led into a fractional distillator 20 via line 28. Here the deasphalted product is fractionated to remove deasphalting solvent via line 32 for recycle to the deasphalter. The resultant liquid from fractionator distillator 20 is combined via line 30 with the boiling point separator liquid from line 24 which has a boiling point of from about 600° F. to about 800° F. This combined mixture is fed into the coal liquefaction reactor 14, via line 30, along with manganese nodules and coal where under coal liquefaction conditions, the coal is liquified. The liquid bottoms or residue from the deasphalter 18, along with the fractionated bottoms, is reclaimed for further processing via line 36.

In another embodiment, the residual or non-distillable bottoms stream from line 26 is extracted with a solvent. The solvent utilized will depend upon the solvent extraction process used. The process utilized can be either a supercritical extraction process or a liquid phase extraction process. If either process is used, a supercritical extractor is substituted for the deasphalter 18.

When contacting the residual bottoms with hexane or lighter hydrocarbons, a supercritical solvent extraction process can be utilized. As is understood by those skilled in the art, solvents which are preferred in a supercritical solvent extraction process include propane, pentane, hexane, heptane, and mixtures thereof. Carbon dioxide can also be used as a supercritical solvent.

Where desired or dictated, heavier solvents can be utilized in a liquid phase solvent extraction process. Naphtha can be used for instance. This solvent has been used in a solvent extraction process in U.S. Pat. No. 4,292,164 which issued to Derbyshire et al. on Sept. 29, 1981. This patent is hereby incorporated by reference.

After contacting the residual or non-distillable bottoms stream with said solvent, the mixture is allowed to separate. The heavier solvent extracted residual bottoms stream is removed from the supercritical solvent extractor 18. The solvent containing the extractables is removed from the supercritical solvent extractor 18 via line 28. The solvent is separated in 20 and recycled for further use in the process via line 32.

In order to maximize the quantity of aromatic components which possess polarographic reduction potentials greater than about −2.4 volts in the solvent, the boiling point separator stream from line 24, containing liquids with boiling points from about 600° F. to about 800° F., is combined with the deasphalted bottoms. Combining these streams occurs after deasphalting or supercritical solvent extraction of the residual stream. After mixing together, the mixture may either be deasphalted or subjected alternately to supercritical solvent extraction as in the embodiments above, and further processed similarly.

The following examples will be illustrative of the invention.

EXAMPLE 1

Manganese nodules obtained from the bottom of Green Bay in Lake Michigan were washed to remove lake water and mud therefrom and were then pulverized to pass through a 200-mesh screen. They were then washed with boiling water. The crushed and washed nodules had the following physical properties and chemical composition:

| Physical Properties | | |
|---|---|---|
| Surface Area | 148 | Square meters/gram |
| Particle Density | 1.80 | Grams/cubic centimeter |
| Pore Diameter | 67 | Angstroms, average |
| Pore Volume | 0.25 | Cubic centimeter/gram |
| Real Density | 3.39 | Grams/cubic centimeter |

-continued

| Chemical Composition, Wt. % | |
|---|---|
| Mn | 5.44 |
| Fe | 31.3 |
| CoO | .02 |
| Cu | .01 |
| MoO3 | .04 |
| Ash | 88.0 |

Figure 2:
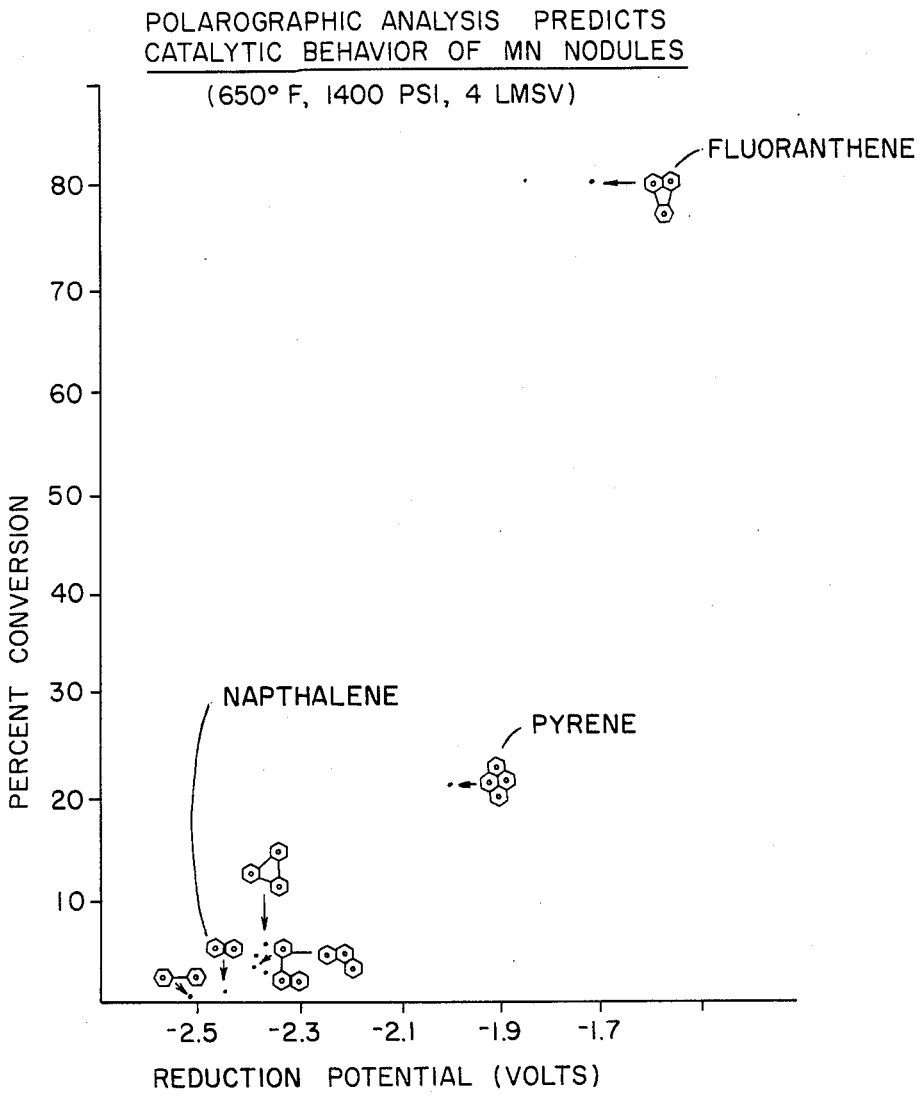
FIG. 2 is graphical representation of the polarographic analysis of expected behavior of designated chemical compounds in the presence of manganese nodules.

These manganese nodules were employed in model compound studies using many different model compounds that could potentially be hydrogenated to H-donors. As shown in FIG. 2, the greatest hydrogenation over manganese nodules occurred for materials possessing polarographic reduction potentials greater than −2.4 volts which fortuitously coincides with the reduction potential of those compounds that make the best H-donors species. As shown in FIG. 2, compounds such as naphthalene which when hydrogenated form tetralin, a classical donor of limited effectiveness, are not hydrogenated to any appreciable extent whereas compounds such as pyrene and fluoranthene are hydrogenated in larger proportions to donors of high effectiveness. The net result of such selectivity is the efficient use of hydrogen.

EXAMPLE 2

In this example, three runs are compared. In the first, coal was liquefied in a solvent isolated from a coal liquid by solvent factionation of the type specified above. In the second run, the same conversion was attempted using the same solvent that had been conventionally hydrotreated in a first stage prior to use in liquefaction. Finally, the same solvent was employed in a single stage coal liquefaction process in the presence of manganese nodules.

Table 1 compares the results of the three runs. Conversions shown in Table 1 were obtained by using naphtha extracted recycle solvents.

TABLE 1

| Coal<br>Solvent<br>Catalyst | Wyodak<br>Parent<br>None | Wyodak<br>Hydrotreated*<br>None | Wyodak<br>Parent<br>Mn Nodules |
|---|---|---|---|
| Solvent/Coal | 2.2/1 | 2.2/1 | 2.2/1 |
| Coal/Catalyst | — | — | 1/0.16 |
| % Coal Conversion Mat Basis | 53.0 | 64.2 | 70.3% |
| % Selectivity to Heptane Solubles | 36.2 | 50.9 | 57.9% |

*Pre-Hydrotreated over a conventional Co—Mo/$\gamma$-$Al_2O_3$ catalyst.

As shown above, when used with solvents isolated as per this invention, manganese nodules are more effective in converting the coal and in producing high quality (heptane soluble) liquids than is pre-hydrotreating of the solvent. Being inherently lower in cost, manganese nodules can be used in the same environment as the feed coal and disposed of thereafter. Utilization of an expensive conventional hydrotreating catalyst is thus not required in this novel process.

Although the present invention has been described with preferred embodiments, it is to be understood that modifications and variations may be resorted to without departing from the spirit and scope of this invention, as those skilled in the art will readily understand. Such modifications and variations are considered to be within the purview and scope of the appended claims.

What is claimed is:

1. A one-stage method for the liquefaction of coal under liquefaction conditions in the presence of manganese nodules in combination with an improved coal liquefaction solvent containing polycondensed aromatic systems or components possessing polarographic reduction potentials of about −1.0 to about −2.0 volts comprising the steps of:

(a) reacting said coal with hydrogen in the presence of a catalyst comprising manganese nodules, and a solvent containing substantially those polycondensed aromatic systems or components that possess polarographic reduction potentials of about −1.0 to about −2.0 which produces substantially larger proportions of hydrogen donors with substantially greater coal conversion effectiveness than does pre-hydrotreating said coal solvent;

(b) conducting the reaction at a temperature of at least about 500° F. and at a pressure of at least about 1000 psig; and (c) recovering the resulting hydrocarbonaceous components obtained therefrom.

2. The method as recited in claim 1 where in step (a) said solvent further comprises a deasphalted residual or non-distillable bottoms portion and a distillate portion with components having a boiling point range of from about 600° F. to about 800° F. both of which portions are liquids derived from a coal liquefaction reaction.

3. The method as recited in claim 1 where in step (a) said solvent further comprises a deasphalted residual or non-distillable bottoms portion and a distillate portion with components having a boiling point range of from about 600° F. to about 800° F. both of which are fractionally distilled and derived from a boiling point separator in a coal liquefaction process.

4. The method as recited in claim 1 where in step (a) said solvent further comprises a residual or non-distillable bottoms portion and a distillate portion with components having a boiling point range of from about 600° F. to about 800° F. both of which have been extracted with a supercritical solvent.

5. The method as recited in claim 4 where the supercritical solvent is a material selected from the group consisting of propane, pentane, hexane, heptane and mixtures thereof.

6. The method as recited in claim 4 where the supercritical solvent is $CO_2$.

7. The method as recited in claim 1 where in step (a) said solvent further comprises a residual or non-distillable bottoms portion and a distillate portion with components having a boiling point range of from about 600° F. to about 800° F. which portions are deasphalted, fractionally distilled, and derived from a coal liquefaction reaction.

8. The method as recited in claim 1 where in step (a) said solvent further comprises a residual or non-distillable bottoms portion and a distillate portion with components having a boiling point range of from about 600° F. to about 800° F. which portions are deasphalted, fractionally distilled, and derived from a boiling point separator in a coal liquefaction process.

9. The method as recited in claim 1 where in step (a) said solvent further comprises a residual or non-distillable bottoms portion and a distillate portion with components having a boiling point range of from about 600° F. to about 800° F. which portions are extracted with a supercritical solvent, fractionally distilled, and derived from a coal liquefaction reaction.

10. The method as recited in claim 1 where in step (a) said solvent further comprises a residual or non-distillable bottoms portion and a distillate portion with components having a boiling point range of from about 600° F. to about 800° F. which portions are extracted with a supercritical solvent, fractionally distilled, and derived from a boiling point separator in a coal liquefaction process.

11. The method as recited in claim 1 where in step (a) said manganese nodules are mixed with the coal in portions of from about 5% to about 50% by weight.

12. The method as recited in claim 1 where in step (a) said manganese nodules are mixed with the coal in about 10% by weight with coal.

13. The method as recited in claim 1 where in step (b) the reaction pressure is from about 1000 psig to about 4600 psig.

14. The method as recited in claim 1 where in step (b) the reaction pressure is from about 2000 psig to about 2500 psig.

15. The method as recited in claim 1 where in step (b) the reaction is conducted at a temperature of from about 500° F. to about 900° F.

16. The method as recited in claim 1 where in step (b) the reaction temperature is maintained for about 0.25 of an hour to about 2 hours.

17. The method as recited in claim 1 where in step (b) the reaction is conducted at a temperature of from about 750° F. to about 840° F.

18. In a one stage process for the liquefaction of coal where said coal is reacted with hydrogen or with a mixture of carbon monoxide and water, in the presence of a coal liquefaction solvent, said reacting step being conducted at a temperature of at least 500° F. and at a pressure of at least 1000 psig, in the presence of, as a catalyst, the naturally occurring underwater deposit known as manganese nodules, which results in the recovery of hydrocarbonaceous liquids, the improvement comprising:

conducting said process with a solvent containing substantially those polycondensed aromatic systems or components that possess polarographic reduction potentials of about −1.0 to about −2.0 volts which produces substantially larger proportions of hydrogen donors with substantially greater coal conversion effectiveness than does pre-hydrotreating said coal solvent.

19. The process as recited in claim 18 where said solvent further comprises a deasphalted residual or non-distillable bottoms portion and a distillate portion with components having a boiling point range of from about 600° F. to about 800° F. both of which are fractionally distilled and derived from a boiling point separator in a coal liquefaction process.

20. The process as recited in claim 18 where said solvent further comprises a residual or non-distillable bottoms portion and a distillate portion with components having a boiling point range of from about 600° F. to about 800° F. both of which have been extracted with a supercritical solvent.

* * * * *